US007435334B2

(12) United States Patent
Magne-Drisch et al.

(10) Patent No.: US 7,435,334 B2
(45) Date of Patent: Oct. 14, 2008

(54) PROCESS FOR DESULFURIZATION OF GASOLINES

(75) Inventors: Julia Magne-Drisch, Villette de Vienne (FR); Florent Picard, Saint Symphorien D'Ozon (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 579 days.

(21) Appl. No.: 10/896,859

(22) Filed: Jul. 23, 2004

(65) Prior Publication Data

US 2005/0061711 A1 Mar. 24, 2005

(30) Foreign Application Priority Data

Jul. 25, 2003 (FR) ..... 03 09200

(51) Int. Cl.
*C10G 17/00* (2006.01)
*C10G 45/00* (2006.01)

(52) U.S. Cl. ..... 208/208 R; 208/211; 208/212

(58) Field of Classification Search ..... 208/208 R, 208/218, 237, 238, 211, 212
See application file for complete search history.

(56) References Cited

U.S. PATENT DOCUMENTS 4,775,462 A * 10/1988 Imai et al. ..... 208/189
5,454,933 A * 10/1995 Savage et al. ..... 208/212
5,599,441 A * 2/1997 Collins et al. ..... 208/208 R
5,863,419 A * 1/1999 Huff et al. ..... 208/237
6,171,478 B1 * 1/2001 Cabrera et al. ..... 208/212
6,334,948 B1 * 1/2002 Didillon et al. ..... 208/218
2001/0050245 A1 * 12/2001 Hearn et al. ..... 208/189
2003/0029776 A1 2/2003 Pradhan et al
2003/0042175 A1 * 3/2003 Debuisschert et al. ..... 208/211

FOREIGN PATENT DOCUMENTS

FR 2821850 9/2002
WO WO 9909117 2/1999

* cited by examiner

*Primary Examiner*—Walter D. Griffin
*Assistant Examiner*—Frank C Campanell
(74) *Attorney, Agent, or Firm*—Millen, White, Zelano, Branigan, P.C.

(57) ABSTRACT

The invention relates to a process for the production of a gasoline with a low sulfur content starting from an initial gasoline that comprises olefins, thiophene compounds and mercaptans and comprises a stage for treating at least one fraction of the initial gasoline under conditions of alkylation of the thiophene compounds by the olefins, a stage for treating at least one fraction of the effluent that is obtained from the preceding stage under conditions of addition of the olefins to the mercaptans, and a distillation stage for obtaining a light fraction that is low in thiophene compounds and mercaptans, and a heavy fraction that is high in sulfur.

24 Claims, No Drawings

PROCESS FOR DESULFURIZATION OF GASOLINES

This invention relates to a process that makes it possible to reduce the contents of sulfur contained in the gasolines.

More specifically, the invention relates to a scheme for desulfurization of gasolines also comprising olefins. Although it is not limited, this process finds its application in particular in the transformation of conversion gasolines and in particular the gasolines that are obtained from catalytic cracking, fluidized-bed catalytic cracking (FCC), a coking process, a visbreaking process, or a pyrolysis process. The process makes it possible to produce a gasoline with a low sulfur content and a high octane number.

The process that is the object of this invention may also make it possible to upgrade a gasoline that optionally comprises hydrocarbons with two, three or four carbon atoms, by reducing the total sulfur content of said fraction to very low levels that are compatible with current or future specifications, without appreciable reduction of the gasoline yield and the octane number.

The production of reformulated gasolines that meet new environmental standards requires in particular that their sulfur content be significantly reduced to values that do not exceed 50 ppm by weight in 2005, and even 10 ppm by weight in certain countries and in the near future. It is known, however, that the conversion gasolines, and more particularly those that are obtained from catalytic cracking, which can represent 30 to 50% of the gasoline pool, exhibit high olefin and sulfur contents. The sulfur that is present in the reformulated gasolines for this reason can generally be nearly 90% attributed to the gasolines that are obtained from catalytic cracking processes (also called FCC, "Fluid Catalytic Cracking," or fluidized-bed catalytic cracking).

Conventionally used within the refinery, a first method that allows the elimination of sulfur-containing compounds consists of the hydrodesulfurization of such gasolines. To meet the standards described above using such processes, it turns out to be necessary, however, to operate under strict temperature and pressure conditions and under heavy hydrogen pressure. Such conditions bring about a high consumption of hydrogen, generally a hydrogenation of at least 20% of the olefins, and an appreciable reduction of the octane number of the finally recovered desulfurized gasolines. The hydrogen flow rates are typically higher than 100 liters per liter of treated feedstock.

According to another method, processes for desulfurization of gasolines by a treatment on an acid catalyst have been proposed. This type of treatment has as its object to increase the weight of thiophenic unsaturated sulfur-containing compounds by a reaction of addition (or alkylation) on said unsaturated sulfur-containing compounds of olefins that are present in the feedstock. For example, Patents U.S. Pat. Nos. 6,048,451 and 6,059,962 describe such processes. The thiophenic, unsaturated, sulfur-containing compounds react with the olefins in the presence of an acid catalyst, the reaction producing an increase in weight of said compounds. The weighted sulfur-containing compounds can then be separated by a simple distillation. A gasoline with a low sulfur content is recovered at the top of the distillation column. According to a similar process that is described in U.S. Pat. No. 5,863,419, the acid catalyst can be placed directly in the distillation column. In this case, the weighted sulfur-containing compounds are extracted from the bottom of the column while the desulfurized gasoline is extracted at the top of the column.

The experiments that are conducted by the applicant allow it to appear, however, that the desulfurization processes described above make it possible to treat primarily the thiophenic, unsaturated, sulfur-containing compounds but are not very effective, however, for the saturated sulfur-containing compounds, such as the mercaptans, the cyclic or linear sulfides, and, to a lesser extent, the disulfides. Moreover, the treatment of a gasoline that comprises olefins on an acid catalyst can generate diolefins by hydrogen transfer reaction. It is known that these diolefins are at the origin of the formation of gums in gasoline.

To resolve the problem raised by the joint elimination of the saturated sulfur-containing compounds and unsaturated sulfur-containing compounds, Patent Application WO 02/072740 proposes a scheme of successive stages of selective hydrogenation, increasing the weight of light sulfur-containing compounds of the mercaptan type, increasing the weight of thiophene compounds and fractionation of the effluent that is thus produced, the heaviest fraction that concentrates the sulfur-containing compounds finally undergoing a hydrodesulfurization treatment.

This invention relates to a process for the production of a gasoline with low sulfur content starting from an initial gasoline that comprises olefins, thiophene compounds and mercaptans that comprise the following stages:

a) a treatment of at least one fraction of the initial gasoline under conditions of alkylation of the thiophene compounds by the olefins, b) a treatment of at least one fraction of the effluent that is obtained from stage a) under conditions of addition of olefins to the mercaptans, c) a distillation of the effluent that is obtained from stage b) under conditions of obtaining at least two fractions, including:

a light fraction $\alpha$ that is low in thiophene compounds and in mercaptans, a heavy fraction $\beta$ that is high in sulfur and comprises a large portion of the sulfur-containing compounds that are formed during stages a) and b).

Advantageously, the process also comprises a stage for treatment of at least heavy fraction $\beta$ on a catalyst that makes it possible to decompose at least partially, in the presence of hydrogen, the sulfur-containing compounds that are contained in said fraction $\beta$ into hydrocarbons and into hydrogen sulfide.

According to a possible mode, the process also comprises a stage for desulfurization of at least heavy fraction $\beta$ with a process that is selected from the group that consists of: adsorption, oxidation and extraction by solvent of the sulfur-containing compounds.

This process may also comprise a stage for distillation of the initial gasoline, only the fraction of the initial gasoline comprising the thiophene and the methylthiophenes being treated according to stage a).

According to another possible mode, the process also comprises a stage c') for distillation of the effluent that is obtained from stage a), only the light fraction that is obtained from said stage c') being treated according to stage b).

The process may comprise a preliminary stage for selective hydrogenation of at least a portion of diene and acetylene compounds that are contained in the initial gasoline.

The process may also comprise a preliminary stage for extraction of at least a portion of the nitrogen-containing compounds that are contained in the initial gasoline.

Advantageously, stage a) is used in the presence of an acid catalyst that is selected from the group that consists of resins, zeolites, silica-aluminas, clays, and silicas that comprise at least one acid group such as phosphoric acid, grafted substrates of acidic functional groups.

Most often, stage b) is used in the presence of a catalyst that comprises at least one metal of group VIII and at least one metal of group VIB.

Stage b) is generally implemented in the presence of hydrogen.

Without exceeding the scope of the invention, stages b) and c) can be carried out in a reactive distillation column.

This process makes it possible, for example, to treat an initial gasoline comprising a hydrocarbon-containing fraction that is obtained from a process of catalytic cracking, of fluidized-bed catalytic cracking, of coking, of visbreaking or of pyrolysis.

The applicant found that the process as it was just described offered, relative to the processes of the prior art and in particular relative to the process described in Application WO 02/072740, significant advantages, and in particular:

- a lower sulfur content of the gasoline produced globally, without loss of additional octane for a low hydrogen consumption,
- the production of a sweetened gas that contains a reduced amount of compounds of mercaptan type as well as a reduced content of all of the saturated sulfur-containing compounds,
- at least partial elimination of the diolefins that could be formed during the stage for treatment of the thiophene compounds (stage a) because of the hydrogen transfer reactions.

In a non-limiting manner, the experimental conditions of stages a), b) and c) could be, for example, those as described below:

1°) Stage a)

This stage consists in running the gasoline over a catalyst that exhibits an acid function that makes it possible to carry out the addition of olefins that are present in the gasoline, primarily over the thiophenic sulfur-containing compounds. Said sulfur-containing compounds are primarily unsaturated compounds such as the thiophene and the methylthiophenes. However, it is well understood, within the meaning of this description, that under the conditions of this alkylation, a fraction of the saturated sulfur-containing compounds, in particular of mercaptan type, can react with the olefins to form heavier sulfides. The products of addition of olefins to the thiophenic sulfur-containing compounds are sulfur-containing compounds whose boiling point was moved most often from at least 60° C. to higher boiling points. For example, stage a) can be carried out such that at least 70% by weight, preferably at least 80% by weight, and very preferably at least 90% by weight of thiophenes and methylthiophenes that are initially present in the feedstock react.

During stage a), in particular based on the catalyst that is used, a portion of the olefins of the starting gasoline can be converted into branched, long olefins by oligomerization reactions. To reduce the activity of such a catalyst, it is possible, without exceeding the scope of the invention, to add to the feedstock an inhibitor of acid catalysts such as alcohols, ethers or water.

Stage a) is generally carried out in the presence of an acid catalyst. This catalyst can be a resin, a zeolite, a silica alumina, a clay, any silica that is functionalized by an acid group, such as phosphoric acid, or any grafted substrate of acidic functional groups. Without exceeding the scope of the invention, it is, of course, possible to use any known catalyst to promote the reactions between olefins and thiophene compounds, in particular the compositions that are described in Patents U.S. Pat. No. 6,048,451 or U.S. Pat. No. 6,059,962. The ratio of the volumetric flow of feedstock to the volume of catalyst is generally encompassed between 0.1 and 10 l/h/l and preferably between 0.3 and 5 l/h/l. The temperature for this stage can be between 50° C. and 250° C. and preferably between 100° C. and 220° C. The operating pressure is between 1 MPa and 4 MPa and is preferably adjusted so that the feedstock is in liquid form in the reactor.

The molar ratio between the olefins and the sulfur-containing compounds that are present in the feedstock will be, for example, higher than 10.

2°) Stage b)

Stage b), after this process in stage a), has as its object to treat light gasoline by increasing in weight, by an addition reaction of olefins, the saturated sulfur-containing compounds of mercaptan type as well as the sulfides or disulfides that are optionally present in the feedstock and that have not been transformed during stage a). The gasoline is preferably treated on a catalyst that comprises at least one metal of group VIII, preferably selected from the group that is formed by platinum, palladium and nickel, and a substrate. For example, a catalyst that contains 1 to 20% by weight of nickel, deposited on an inert substrate, such as, for example, alumina, silica, silica-alumina, a nickel aluminate or a substrate that contains at least 50% alumina, will be used. This catalyst operates under a pressure of 0.4 to 5 MPa, at a temperature of 50 to 250° C., with an hourly volumetric flow rate of the liquid of 1 $h^{-1}$ to 10 $h^{-1}$.

Another metal of group VIB can be connected to form a bimetallic catalyst, such as, for example, molybdenum or tungsten. This metal of group VIB, if it is combined with a metal of group VIII, is generally deposited at a rate of 1% by weight to 20% by weight on the substrate. This catalyst advantageously can be used in its sulfurized form. It is necessary to carry out a preliminary sulfurization before injection of the feedstock to be treated. This sulfurization can be carried out in situ by injection of a sulfurization agent such as DMDS (dimethyl disulfide) in a mixture with hydrogen at a temperature that is generally higher than 300° C. This sulfurization can also be carried out ex situ, without exceeding the scope of the invention.

The operation is carried out most generally under pressure in the presence of a small amount of hydrogen. The hydrogen flow rate is typically between 0.1 l/l and 20 l/l, expressed in normal liters of hydrogen per liter of gasoline. In all cases, this flow is much lower than the flow rates that are used in the standard hydrodesulfurization stages that are more typically higher than 100 liters of hydrogen per liter of feedstock. The hydrogen and the feedstock to be treated are injected in upward or downward flows into a reactor, preferably with a fixed catalyst bed. The temperature is most generally between 50 and 300° C., and preferably between 80 and 250° C., and preferably between 120 and 210° C.

The pressure is selected as adequate for keeping more than 80%, and preferably more than 95%, by weight of the gasoline to be treated in liquid phase in the reactor: it is most generally 0.4 to 5 MPa and preferably higher than 1 MPa. An advantageous pressure is between 1 to 4 MPa, inclusive.

The volumetric flow rate is typically, under these conditions, on the order of 1 to 12 $h^{-1}$, preferably on the order of 2 to 10 $h^{-1}$.

During this stage, at least 50% by weight of mercaptans, preferably at least 70% by weight and very preferably at least 80% by weight, are weighted by reacting with the olefins.

Said compounds are, for example and typically, encompassed in the group that consists of the mercaptans comprising 2 to 5 carbon atoms.

For some embodiments of the invention, it may be advantageous to implement stage b) at the same time as stage c) for distillation that is described in the description below, by use of a reactive distillation column. In this case, the catalyst of stage b) is placed in the rectification zone of the distillation column. The hydrogen that is optionally used in stage b) is injected onto a plate that is located in the catalytic zone. In this configuration, the sulfur-containing compounds that are weighted during stage b) are recovered at the bottom of the distillation column.

3°) Stage c)

According to this stage, the effluent that is obtained from stage b) is fractionated by, for example, a standard distillation process into at least two fractions:

- a light fraction α whose sulfur content is significantly less than the sulfur content of the equivalent fraction of the feedstock, i.e., of the same distillation interval,
- a heavy fraction β that concentrates the sulfur-containing compounds and that exhibits a sulfur content that is higher than the sulfur content of the equivalent fraction of the feedstock.

In general, the light gasoline contains the majority of hydrocarbons with 5, 6 and 7 carbon atoms, often less than 30% by weight, most often less than 20% by weight, and even less than 10% by weight of thiophene and methyl thiophenes that are present in the initial feedstock and less than 20% by weight, most often less than 10% by weight, and even less than 5% by weight of saturated sulfur-containing compounds that are present in the feedstock.

The heavy gasoline fraction contains, for example, the majority of hydrocarbons with more than 9 carbon atoms, all of the sulfur-containing compounds that have increased in weight during stages a) and b) as well as the heavy sulfur-containing compounds that are initially present in the feedstock.

According to an embodiment of this invention, fraction β can be subjected to an intense desulfurization before being remixed with fraction α and/or sent to the gasoline pool. The desulfurization comprises a stage in which the sulfur-containing compounds are decomposed into hydrocarbons and into hydrogen sulfide. This stage is preferably carried out by a known treatment under hydrogen on a hydrodesulfurization catalyst that contains a metal of group VIII. According to the required specifications and in particular the maximum sulfur content of the gasoline that is ultimately obtained and/or its octane number, hydrodesulfurization can be implemented conventionally, i.e., with a significant saturation of olefins, or, selectively, i.e., by limiting the hydrogenation of olefins.

According to an embodiment of the invention, only a fraction of the initial feedstock, i.e., the one that concentrates the lightest thiophene compounds (thiophene, methylthiophenes) is treated according to stage a). This fraction can be easily obtained, for example, by a preliminary distillation of the initial sulfur-containing gasoline that is to be treated. In this case, the end point of the gasoline fraction that is sent into stage a) will generally be less than 200° C., preferably less than 160° C., and very preferably less than 130° C. The fraction of the gasoline that is not sent to stage a) can then be either remixed with effluents that are obtained from stage a) or treated separately following a stage for increasing the weight as described in stage b).

According to another embodiment of the invention, a separation by distillation (stage c')) can be carried out between stages a) and b) as they have just been described. Only the lightest fraction that is obtained from this stage c') is treated under the conditions of stage b). Finally, the effluent that is obtained from stage b) is separated according to stage c) as described above. In this embodiment, the fraction point of the first distillation (stage c') is higher than the fraction point of the second distillation (stage c)), for example by at least 30° C., preferably at least 20° C., and even 15° C. This embodiment has the advantage of further reducing the level of sulfur-containing compounds present in the light fraction that is ultimately obtained, as well as lowering the amount of gasoline to be treated during stages b) and c).

Furthermore, it is possible that the acid catalyst that is used in stage a) can be deactivated by compounds of diolefin and nitrogen-containing type. Without exceeding the scope of the invention, the following two pre-treatment stages can then be considered, preferably in the order set forth below:

- selective hydrogenation of the gasoline. This stage can be used under conditions that are identical to the conditions that are described in stage b), but by ensuring, for example, that the molar ratio of the hydrogen to the diolefins is greater than 1 mol/mol,
- extraction of nitrogen-containing compounds by treatment on a collection mass and/or by acidic washing. The collection mass that is used will preferably be an acid mass. The acidic washing will be implemented by use of an aqueous solution of protonic acid such as, for example, sulfuric acid, phosphoric acid, hydrochloric acid or citric acid.

The following examples make it possible to illustrate the advantages of this invention.

EXAMPLE 1

Not in Accordance with the Invention

Example 1 is given by way of comparison so as to show the performance levels and the qualities of products that are obtained by a process that comprises stage a) for alkylation of unsaturated sulfur-containing compounds by olefins on an acid catalyst and stage c) for distillation of the product that is obtained from stage a).

Example 1 is not in accordance with the invention. Actually, it does not comprise stage b), where saturated sulfur-containing compounds of mercaptan, sulfide, or disulfide type are added to the olefins.

The treated FCC A gasoline is a total gasoline that covers the range of boiling points from 0 to 175° C. The fraction of 0 to 105° C. represents 67% by weight of the total gasoline. The total content of sulfur contained in this gasoline is 215 ppm by weight. The content of olefins of the gasoline is 43% by weight. The content of diolefins is 1.2% by weight. The distribution of the sulfur-containing compounds contained in gasoline A is provided in Table 1.

TABLE 1

Sulfur-containing compounds of gasoline A

| Sulfur-Containing Compounds | Concentration (ppm by Weight) |
|---|---|
| Mercaptans | 44.6 |
| Sulfides | 17.1 |
| Disulfides | 49.1 |
| Thiophene | 21.0 |
| Methylthiophene | 49.6 |
| C2-Thiophene (Ethyl- or Dimethylthiophene) | 35.9 |
| Heavy Sulfur-Containing Compounds (Boiling point > 144° C.) | 16.1 |
| Not Identified | 2.0 |

The acid catalyst that is used during stage a) is a phosphoric acid with a silica substrate. The operating conditions for using this catalyst are as follows: 170° C., 2.5 MPa, and the ratio of the feedstock volumetric flow to the volume of the catalyst is 1.5.

The detailed composition of the sulfur-containing compounds of product B that is obtained from stage a) is provided in Table 2. The values are expressed in ppm by weight.

TABLE 2

Sulfur-containing compounds of product B obtained from treatment of gasoline A by stage a) and distillation fractions obtained from product B (values expressed in ppm by weight)

| Sulfur-Containing Compounds | Product B | Fraction B1 Light Gasoline 0-105° C. | Fraction B2 Heavy Gasoline 105° C.+ |
|---|---|---|---|
| Mercaptans | 14.2 | 25.7 | 2.2 |
| Sulfides | 16.5 | 9.6 | 20.3 |
| Disulfides | 1.9 | 1.2 | 2.5 |
| Thiophene | 1.7 | 3.6 | 0.0 |
| Methylthiophenes | 5.3 | 4.1 | 7.1 |
| C2-Thiophene (Ethyl- or Dimethylthiophene) | 20.4 | 0.3 | 37.3 |
| Heavy Sulfur-Containing Compounds (Boiling Point > 144° C.) | 171.3 | 0.2 | 345.6 |
| Not Identified | 4.7 | 1.2 | 9.7 |

Stage a) made it possible to convert the sulfur-containing compounds of the FCC A gasoline in the following proportions:

among the unsaturated sulfur-containing compounds:

the thiophene was converted at a level of 92% the methylthiophenes were converted at a level of 89%, or an overall conversion for the light thiophenic unsaturated sulfur-containing compounds of 90%, the saturated sulfur-containing compounds were converted at a level of 71%.

The diolefin content of product B obtained from stage a) is 0.6% by weight.

Product B that is obtained from stage a) is then distilled so as to recover a light gasoline that is low in sulfur at the top, and sulfur-containing compounds that are weighted during stage a) at the bottom of the column. The fraction point between light gasoline and heavy gasoline is 105° C.

The proportions of the two fractions that are produced by distillation of product B that is obtained from stage a) are:

47.8% by weight of light gasoline, 52.2% by weight of heavy gasoline.

The total amount of sulfur measured is 45.8 ppm by weight for light gasoline, including 25.7 ppm by weight of mercaptans and 425 ppm by weight for the heavy gasoline. The detailed composition of the sulfur-containing compounds of fractions obtained from the distillation of product B is provided in Table 2.

The diolefin contents of the two fractions obtained from the distillation are 0.1% by weight for the light gasoline and 1.3% by weight for the heavy gasoline.

EXAMPLE 2

For Comparison

Example 2, according to the process that is described in Patent Application WO 02/072740, is provided by way of comparison. It makes it possible to compare the performance levels that are obtained during the treatment of an FCC gasoline by stage b), where the sulfur-containing compounds of mercaptan and sulfide type are added to the olefins primarily via the stages a) for alkylation of sulfur-containing compounds by the olefins on an acid catalyst and finally c) for distillation of the gasoline that is obtained from stage a).

The same FCC A gasoline as the one that is described in Example 1 is used. Stage b) is carried out by treatment of gasoline A on a fixed-bed reactor that is loaded with HR845® catalyst with a nickel and molybdenum base marketed by the Axens Company, in the presence of hydrogen. The reaction is carried out at 165° C., under a pressure of 20 bar (2 MPa) and a volumetric flow rate of 4 $h^{-1}$. The $H_2$/feedstock ratio that is expressed in liter of hydrogen per liter of feedstock is 6. The gasoline that is thus produced during stage b) is gasoline C, whose characteristics are provided in Table 3.

Gasoline C that is thus obtained is then treated by stage a) for alkylation of the sulfur-containing compounds according to the same conditions as those described in Example 1, i.e., in the presence of an acid catalyst of phosphoric acid type with a silica substrate, whereby the operating conditions of implementation of this catalyst are: 170° C., 25 bar, and the ratio of the volumetric flow of feedstock to the volume of catalyst of 1.5.

The detailed composition of the sulfur-containing compounds of product D that is obtained from the treatment of gasoline C by stage a) is provided in Table 3.

The scheme of stages b) and a) made it possible to convert the sulfur-containing compounds of the FCC A gasoline according to the following proportions:

among the unsaturated sulfur-containing compounds:

the thiophene was converted at a level of 92%, the methylthiophenes were converted at a level of 90%, or an overall conversion for the lightest thiophenic unsaturated sulfur-containing compounds at a level of 91%, the saturated sulfur-containing compounds were converted at a level of 94.6%.

The content of diolefins of product D obtained from stage a) is 0.4% by weight.

Product D that is obtained from successive stages b) then a) is then distilled so as to recover a light gasoline that is low in sulfur at the top, and sulfur-containing compounds that are weighted when stages b) and a) are linked together at the bottom of the column. The fraction point between light gasoline and heavy gasoline is 105° C. as in Example 1.

The proportions of the two fractions that are produced by distillation of product D that is obtained from successive stages b), then a), are:

51.4% by weight of light gasoline 48.6% by weight of heavy gasoline.

The total amount of sulfur measured is 11 ppm by weight for the light gasoline, including 2.2 ppm by weight of mercaptan and 460 ppm by weight for the heavy gasoline. The detailed composition of the sulfur-containing compounds of the fractions obtained from the distillation of product D is provided in Table 3. The values are expressed in ppm by weight.

The diolefin contents of the two fractions that are obtained from the distillation are 0.05% by weight for the light gasoline and 0.6% by weight for the heavy gasoline.

TABLE 3

Sulfur-containing compounds of gasoline C, product D and fractions of product D (values expressed in ppm by weight)

| Sulfur-Containing Compounds | Gasoline C | Product D | Fraction D1 Light Gasoline 0-105° C. | Fraction D2 Heavy Gasoline 105° C.+ |
|---|---|---|---|---|
| Mercaptans | 1.4 | 2.7 | 2.2 | 2.9 |
| Sulfides | 0.5 | 2.0 | 1.9 | 3.2 |
| Disulfides | 0.0* | 1.4 | 0.2 | 0.4 |
| Thiophene | 22.5 | 1.6 | 2.7 | 0.0* |
| Methylthiophenes | 51.2 | 5.1 | 3.4 | 5.4 |
| C2-Thiophene (Ethyl- or Dimethylthiophene) | 47.3 | 11.3 | 0.1 | 22.5 |
| Heavy Sulfur-Containing Compounds (Boiling Point > 144° C.) | 118.7 | 215.8 | 0.2 | 420.0 |
| Not Identified | 1.9 | 2.6 | 0.2 | 4.9 |

*Less than the detection limit

EXAMPLE 3

According to the Invention

Example 3, according to the invention, makes it possible to show the performance levels that are obtained by the process that is described in the invention comprising stages a) for alkylation of the sulfur-containing compounds by the olefins on the acid catalyst, b) for addition of sulfur-containing compounds of mercaptan and sulfide type to the olefins, and c) for distillation of the gasoline that is obtained from stage b).

The same FCC A gasoline as the one that is described in Example 1 is used. Stage a) is carried out on the same catalyst and under the same conditions as those described in Example 1. The characteristics of product B obtained from stage a) therefore correspond to the description that is provided in Example 1. The composition of the sulfur-containing compounds of product B is presented in Table 4. The values are expressed in ppm by weight.

Product B that is obtained from stage a) is then treated by a stage b) for increasing the weight of the saturated sulfur-containing compounds that have not been transformed during stage a).

Stage b) is carried out in the same way as the one that is described in Example 2, i.e., product B is treated on a fixed-bed reactor that is loaded with catalyst HR845® with a nickel and molybdenum base that is marketed by the Axens Company in the presence of hydrogen. The reaction is carried out at 165° C. under a pressure of 20 bar (2 MPa) and a volumetric flow rate of 4 $h^{-1}$. The $H_2$/feedstock ratio that is expressed in liter of hydrogen per liter of feedstock is 6. The characteristics of product E that is obtained from this stage b) are provided in Table 4.

The scheme of stages a) and b) made it possible to convert the sulfur-containing compounds of the FCC A gasoline according to the following proportions:

Among the unsaturated sulfur-containing compounds:

the thiophene was converted at a level of 92%, the methylthiophenes were converted at a level of 89%, or an overall conversion for the lightest thiophenic, unsaturated, sulfur-containing compounds at a level of 90%, the saturated sulfur-containing compounds were converted at a level of 97.3%.

The content in diolefins of product E that is obtained from stage a) is 0.1% by weight.

Product E that is obtained from stages a) and b) is then distilled so as to recover a light gasoline that is low in sulfur at the top, and the sulfur-containing compounds that are weighted during stages a) and b) at the bottom of the column. The fraction point between light gasoline and heavy gasoline is 105° C. as in Examples 1 and 2.

The proportions that are produced by distribution of product E that is obtained from stages a) and b) are:

52.3% by weight of light gasoline (fraction E1), 47.7% by weight of heavy gasoline (fraction E2).

The total amount of sulfur measured is 8 ppm by weight for the light gasoline, including 0.7 ppm by weight of mercaptan and 462 ppm by weight for the heavy gasoline. The detailed composition of the sulfur-containing compounds from fractions that are obtained from the distillation of product E is provided in Table 4. The values are expressed in ppm by weight.

The diolefin contents of the two fractions that are obtained from the distillation are less than 0.1% by weight for the light gasoline and 0.3% by weight for the heavy gasoline.

TABLE 4

Sulfur-containing compounds of product B, product E and fractions of product E (values expressed in ppm by weight)

| Sulfur-Containing Compounds | Product B | Product E | Fraction E1 Light Gasoline 0-105° C. | Fraction E2 Heavy Gasoline 105° C.+ |
|---|---|---|---|---|
| Mercaptans | 14.2 | 1.9 | 0.7 | 3.2 |
| Sulfides | 16.5 | 0.9 | 0.3 | 1.5 |
| Disulfides | 1.9 | 0.2 | 0.2 | 0.1 |
| Thiophene | 1.7 | 1.6 | 2.9 | 0.0* |
| Methylthiophenes | 5.3 | 5.3 | 3.7 | 7.1 |
| C2-Thiophene (Ethyl- or Dimethylthiophene) | 20.4 | 21.2 | 0.1 | 44.1 |
| Heavy Sulfur-Containing Compounds (Boiling Point > 144° C.) | 171.3 | 191.8 | 0.1 | 402.0 |
| Not Identified | 4.7 | 2.1 | 0.2 | 4.0 |

*Less than the detection limit

The application of this process, by comparison with the processes of Examples 1 and 2, therefore makes possible a substantial reduction of the content of mercaptans of the light gasoline fraction as well as the overall sulfur content in the light gasoline.

EXAMPLE 4

According to the Invention

Example 4 illustrates a possible embodiment of the invention in which a stage c') for additional distillation is implemented between stage a) for alkylation of the sulfur-containing compounds by the olefins on the acid catalyst and stage b) for addition of the sulfur-containing compounds of mercaptan and sulfide type to the olefins on a light fraction that is obtained from distillation.

The same FCC A gasoline as the one that is described in the preceding examples is used. Stage a) is carried out on the same catalyst and under the same conditions as those described in Example 1. The characteristics of product B that is obtained from stage a) therefore corresponds to the description that is provided in Example 1. The composition of the sulfur-containing compounds of product B is presented in Table 5.

Product B that is obtained from stage a) is then distilled so as to recover a light gasoline that is low in sulfur at the top and the sulfur-containing compounds that are weighted during stage a) at the bottom of the column. The fraction point between light gasoline and heavy gasoline is 120° C.

The proportions of the two fractions that are produced by distillation of product B that is obtained from stage a) are:

60% by weight of light gasoline (fraction B3),

40% by weight of heavy gasoline (fraction B4).

The light gasoline (fraction B3) PI-120° C. that is obtained from the distillation of product B is then treated by a stage b) for addition of the sulfur-containing compounds of mercaptan and sulfide type to the olefins according to the same conditions as those described in Examples 2 ane 3, i.e., in a fixed-bed reactor that is loaded with catalyst HR845® with a nickel and molybdenum base that is marketed by the Axens Company, in the presence of hydrogen. The reaction is carried out at 165° C., under a pressure of 2 MPa and a volumetric flow rate of 4 $h^{-1}$. The $H_2$/feedstock ratio that is expressed in liter of hydrogen per liter of feedstock is 6. The characteristics of product F that is obtained from this stage b) are provided in Table 5. The values are expressed in ppm by weight.

Stage b) made it possible to convert 88.4% by weight of saturated sulfur-containing compounds (mercaptans, sulfides, and disulfides) of the light gasoline (fraction B3) that is obtained from product B.

Product F that is obtained from successive stages a), c'), then b) is then distilled (stage c)) so as to recover a light gasoline that is low in sulfur at the top of the column and the sulfur-containing compounds that are weighted during stage b) at the bottom of the column. The fraction point between light gasoline and heavy gasoline is 105° C. as in the preceding examples so as to compare the characteristics and yields for the same fraction point.

The proportions of the two fractions that are produced by distillation of product F that is obtained from stages a), c'), and then b) are:

79.8% by weight of light gasoline (fraction F1), 20.2% by weight of the heavy fraction 105-120° C. (fraction F2).

The total amount of sulfur measured is 8 ppm by weight for the light gasoline, including 0.2 ppm by weight of mercaptan. The detailed composition of the sulfur-containing compounds of the fractions that are obtained from the distillation of product F is provided in Table 5.

The diolefin contents of the two fractions that are obtained from the distillation are less than the detection limits of the device that is used (0.1%).

TABLE 5

Sulfur-containing compounds of product B, fractions that are obtained from product B, product F, and fractions that are obtained from product F (values expressed in ppm by weight)

| Sulfur-Containing Compounds | Product B | Fraction B3 Light Gasoline 0-120° C. | Fraction B4 Heavy Gasoline 120° C.+ | Product F | Fraction F1 Light Gasoline 0-105° C. | Fraction F2 Heavy Gasoline 105° C.+ |
|---|---|---|---|---|---|---|
| Mercaptans | 14.2 | 22.3 | 1.4 | 3.2 | 0.2 | 15.3 |
| Sulfides | 16.5 | 14.1 | 20.2 | 1.1 | 0.0* | 5.6 |
| Disulfides | 1.9 | 1.8 | 2.2 | 0.1 | 0.1 | 0.2 |
| Thiophene | 1.7 | 2.8 | 0.0* | 2.9 | 3.6 | 0.0* |
| Methylthiophenes | 5.3 | 6.7 | 3.3 | 6.7 | 4.0 | 17.1 |
| C2-Thiophene (Ethyl- or Dimethylthiophene) | 20.4 | 9.6 | 36.4 | 10.2 | 0.0* | 26.8 |
| Heavy Sulfur-Containing Compounds (Boiling Point > 144° C.) | 171.3 | 0.3 | 427.9 | 31.1 | 0.0* | 79.2 |
| Not Identified | 4.7 | 2.8 | 7.6 | 0.8 | 0.1 | 1.9 |

*Less than the detection limit

The invention claimed is:

1. A process for the production of a gasoline with a low sulfur content starting from an initial gasoline that comprises olefins, thiophene compounds and mercaptans comprising the following successive stages:

a) a treatment of at least one fraction of the initial gasoline under conditions of alkylation of the thiophene compounds by the olefins, said alkylation being conducted in contact with an acid catalyst, b) a treatment of at least one fraction of the effluent that is obtained from stage a) under conditions of addition of olefins to the mercaptans in contact with a catalyst different from the catalyst in step (a) and comprising at least one group VIII metal, and a hydrogen flow rate of 0.1 l/l to 20 l/l, expressed in normal liters of hydrogen per liter of gasoline, c) a distillation of the effluent that is obtained from stage b) under conditions of obtaining at least two fractions, including:

a. a light fraction α that is low in thiophene compounds and in mercaptans, b. a heavy fraction β that is high in sulfur and comprises a large portion of the sulfur-containing compounds that are formed during stages a) and b).

2. A process according to claim 1 that also comprises a stage for treatment of at least said heavy fraction β on a catalyst making it possible to decompose, in the presence of hydrogen, at least partially the sulfur-containing compounds that are contained in said fraction β into hydrocarbons and into hydrogen sulfide.

3. A process according to claim 1 that also comprises a stage for desulfurization of at least said heavy fraction β with a process that is selected from the group that consists of: adsorption, oxidation and extraction by solvent of the sulfur-containing compounds.

4. A process according to claim 1 that also comprises a stage for distillation of the initial gasoline and in which only the fraction of the initial gasoline comprising the thiophene and the methylthiophenes is treated according to stage a).

5. A process according to claim 1 that also comprises an additional stage c') between stages a) and b) for distillation of the effluent that is obtained from stage a), and in which only a light fraction that is obtained from said stage c') is treated according to stage b).

6. A process according to claim 1 that comprises a preliminary stage for selective hydrogenation of at least a portion of the diene and acetylene compounds that are contained in the initial gasoline.

7. A process according to claim 1 comprising a preliminary stage for extraction of at least a portion of the nitrogen-containing compounds that are contained in the initial gasoline.

8. A process according to claim 1, in which stage a) is implemented in the presence of an acid catalyst that is selected from the group that consists of resins, zeolites, silica-aluminas, clays, silicas that comprise at least one acid group, phosphoric acid, and grafted substrates of acidic functional groups.

9. A process according to claim 1, in which stage b) is implemented in the presence of a catalyst that comprises at least one metal of group VIII and at least one metal of group VIB.

10. A process according to claim 9, in which stage b) is implemented in the presence of hydrogen.

11. A process according to claim 10, in which stages b) and c) are carried out in a reactive distillation column.

12. A process according to claim 1, in which the initial gasoline comprises a hydrocarbon-containing fraction that is obtained from a process of catalytic cracking, of fluidized-bed catalytic cracking, of coking, of visbreaking, and of pyrolysis.

13. A process according to claim 4 that also comprises a stage c') for distillation of the effluent that is obtained from stage a), and in which only the light fraction that is obtained from said stage c') is treated according to stage b).

14. A process according to claim 4 that comprises a preliminary stage for selective hydrogenation of at least a portion of the diene and acetylene compounds that are contained in the initial gasoline.

15. A process according to claim 5 that comprises a preliminary stage for selective hydrogenation of at least a portion of the diene and acetylene compounds that are contained in the initial gasoline.

16. A process according to claim 13 that comprises a preliminary stage for selective hydrogenation of at least a portion of the diene and acetylene compounds that are contained in the initial gasoline.

17. A process according to claim 4 comprising a preliminary stage for extraction of at least a portion of the nitrogen-containing compounds that are contained in the initial gasoline.

18. A process according to claim 5 comprising a preliminary stage for extraction of at least a portion of the nitrogen-containing compounds that are contained in the initial gasoline.

19. A process according to claim 13 comprising a preliminary stage for extraction of at least a portion of the nitrogen-containing compounds that are contained in the initial gasoline.

20. A process according to claim 16 comprising a preliminary stage for extraction of at least a portion of the nitrogen-containing compounds that are contained in the initial gasoline.

21. A process according to claim 8, in which stage b) is implemented in the presence of a catalyst that comprises at least one metal of group VIII and at least one metal of group VIB.

22. A process according to claim 1, wherein the group VIII metal is platinum, palladium or nickel deposited on an inert substrate.

23. A process according to claim 8, wherein the group VIII metal is platinum, palladium or nickel deposited on an inert substrate.

24. A process according to claim 23, wherein the initial gasoline is an FCC gasoline.

* * * * *